United States Patent [19]

Shoji et al.

[11] Patent Number: 4,897,330

[45] Date of Patent: Jan. 30, 1990

[54] IMAGE FORMING METHOD

[75] Inventors: Hisashi Shoji; Satoshi Haneda; Kunihisa Yoshino; Yuki Okuyama, all of Hachioji, Japan

[73] Assignee: Konica Corporation, Tokyo, Japan

[21] Appl. No.: 130,686

[22] Filed: Dec. 9, 1987

[30] Foreign Application Priority Data

| | | | |
|---|---|---|---|
| Dec. 9, 1986 | [JP] | Japan | 61-294291 |
| Dec. 9, 1986 | [JP] | Japan | 61-294292 |
| Dec. 9, 1986 | [JP] | Japan | 61-294293 |
| Dec. 12, 1986 | [JP] | Japan | 61-296889 |
| Dec. 12, 1986 | [JP] | Japan | 61-296890 |

[51] Int. Cl.[4] ..... G03G 13/22

[52] U.S. Cl. ..... 430/54; 430/42; 430/45; 430/100; 430/901

[58] Field of Search ..... 430/42, 45, 54, 901, 430/100

[56] References Cited

U.S. PATENT DOCUMENTS

| | | | |
|---|---|---|---|
| 3,871,878 | 3/1975 | Mino et al. | 430/54 |
| 3,873,310 | 3/1975 | Bean | 430/54 |
| 4,413,044 | 11/1983 | Nishikawa | 430/53 |
| 4,510,223 | 4/1985 | Kuenhle et al. | 430/42 X |
| 4,599,285 | 7/1986 | Haneda et al. . | |
| 4,654,282 | 3/1987 | Ng et al. | 430/54 |
| 4,696,880 | 9/1987 | Shoji et al. | 430/42 |
| 4,756,985 | 7/1988 | Haneda et al. | 430/42 |

FOREIGN PATENT DOCUMENTS

| | | | |
|---|---|---|---|
| 3531098 | 3/1986 | Fed. Rep. of Germany . | |
| 58-11957 | 1/1983 | Japan | 430/45 |
| 60-239769 | 11/1985 | Japan . | |
| 61-32854A | 8/1986 | Japan . | |

*Primary Examiner*—Paul R. Michl
*Assistant Examiner*—Jeffrey A. Lindeman
*Attorney, Agent, or Firm*—Jordan B. Bierman

[57] ABSTRACT

An image forming method wherein a latent image is formed by subjecting an image retainer having a photoconductive layer to a image exposure, a toner image is formed by developing the latent image with a toner, each the step of forming the latent image and the step of forming the toner image are repeated at least one time, and a plurality of toner images formed on the image retainer to a transfer material. At least one of the toner images is formed with a toner which has a spectral transmissivity as to substantially absorb a visible light but transmit a light having a wavelength of 750 nm or more. The latent image is formed by subjecting the image retainer bearing the toner image to an image exposure with a light containing a wavelength component of 750 nm or more.

11 Claims, 5 Drawing Sheets

IMAGE FORMING METHOD

BACKGROUND OF THE INVENTION

1. Field of the Invention

The present invention relates to an image forming method of forming an image on a recording material by electrophotography.

2. Description of the Prior Art

In an image forming apparatus using the electrophotographic or electrostatic recording method, an electrostatic latent image if formed on an image retainer and is developed with charged particle or toner. This apparatus is produced as a reproducing machine or printer. In order to form a multi-color image or a composed image (in which a plurality of documents or image information and a document image are superposed), the aforementioned principle is utilized in the following manner. More specifically, one cycle of (1) charging, (2) image exposure and (3) development is performed twice on the image retainer having a photoconductive layer on a conductive substrate (as is disclosed in Japanese Patent Application No. 58-184381, for example). As an alternative, there is a method of performing twice one cycle of (1) primary charging, (2) secondary charging and image exposure, (3) uniform exposure and (4) development or a method of performing twice one cycle of (1) primary charging, (2) secondary charging, (3) image exposure and (4) development (as is disclosed in Japanese Patent Application No. 58-183152), for example) by using an image retainer in which a transparent insulating layer is formed outside of a photoconductive layer. Any of these methods makes possible a multi-color development or image composition. Since the superposed image can be transferred to a transfer member by a single transfer process, the apparatus for forming the multi-color or composed image can be realized with a simple structure. A developing method therefor is required to perform the development by using a developer composed of a mixture of a nonmagnetic toner and a magnetic carrier, for example, under the conditions specified in Japanese Patent Application Nos. 58-57446 or 60-192712. This developing method belongs to a kind of magnetic brush developing method and is characterized in that the magnetic brush is not brought into contact with the image retainer, but only the toner is flown onto the latent image surface of the image retainer.

In one example of the above-specified image forming apparatus, latent images of different colors are formed by latent image forming means and are developed with toners of corresponding colors.

This multi-color image forming apparatus is represented by an apparatus in which an image retainer (which may hereinafter be called a "photosensitive member") having a photoconductive substance on a conductive substrate is irradiated with an optical beam of a laser or the like to form an electrostatic latent image. In this apparatus, the multi-color image is formed in accordance with the flow chart of FIG. 4.

FIG. 4 illustrates the variations in the surface potential of the image retainer. In FIG. 4: reference letters PH denote the exposed portion of the image retainer; letters DA denote the unexposed portion of the image retainer; letters $T_1$ denote the toner deposited onto the image retainer by a first development; letters $T_2$ denote the toner deposited to the image retainer by a second development; and letters DUP denote the rise of the potential, which has been caused by the deposition of toner $T_1$ to the exposed portion PH by the first development. For purpose of description, the polarity of the latent image is assumed to be positive.

(1) The image retainer is uniformly charged by a charging device to attain a constant positive surface potential E.

(2) A first image exposure is applied with an exposure light source such as a laser, a cathode ray tube or an LED so that the potential of the exposed portion PH drops in accordance with the amount of light.

(3) The electrostatic latent image thus formed is developed by a developing device to which is applied a positive bias substantially equal to the surface potential E of the unexposed portion. As a result, the positively charged toner $T_1$ is deposited to the exposed portion PH having a relatively lower potential to form a first toner image. The region provided with this toner image has its potential raised by DUP as a result of the deposition of the positively charged toner $T_1$ but not usually to the same potential as that of the unexposed portion DA.

(4) Next, the surface of the image retainer provided with the first toner image is subjected to a second charging operation to attain a uniform surface potential E no matter whether the toner $T_1$ is present or not.

(5) The surface of this image retainer is subjected to a second image exposure to form an electrostatic latent image.

(6) This latent image is developed like the foregoing operation (3) with the positively charged toner $T_2$ in a color different from that of the toner $T_1$ to form a second toner image.

Similar processes are accomplished a desired number of times to form the multi-color image on the image retainer. This multi-color toner image is transferred to the transfer material and is fixed by heat or under pressure to attain a multi-color recorded image. In this case, the toner and charges residing on the surface of the image retainer are cleaned so that they may be used for forming a subsequent multi-color image.

The above-specified process can be applied not only to the multi-color image but also to an apparatus for forming a recorded image by composing toner images on an image retainer and transferring them as a whole.

The following two methods exist in case various colors are to be expressed by the methods described above:

(1) The method in which toners of different colors are not directly superposed; and (2) The method in which toners of different colors are superposed.

In the method (1), colors are generated (e.g., additive mixture of colors) in a dummy manner on the recording paper by not superposing but distributing on principle the multi-color toners $T_1$ and $T_2$ on the image retainer 1, as shown in FIG. 5A.

In the method (2), colors are generated (e.g., subtractive mixture of colors) by developing tones of different colors in a superposed manner on a toner image of a certain color, as shown in FIG. 5B.

The color reproductivity of the methods (1) and (2) usually become different even if a common toner is used. As a matter of fact, a method having the methods (1) and (2) in a compatible manner is frequently adopted because the color reproducing range can be widened to reproduce many colors.

Incidentally, if an image exposure light is absorbed when a toner image of the toner $T_1$ formed on an image retainer is irradiated with the image exposure light, the photoconductive layer remains in the insulated state so that its potential will not drop. Then, the toner $T_2$ having been developed later becomes reluctant to be deposited on that position, as shown in FIG. 5D. As a result, the color reproduced region resorting to the method (2) is highly distorted, and the color reproductivity according to the method (1) is troubled, as shown in FIG. 5C, if the positions of the images of the individual colors fail to be strictly registered.

The description thus far made corresponds to the case of inverted development. If the image exposure light is absorbed by the toner $T_1$ when a normal development is to be accomplished, the succeeding toner $T_2$ will in turn be deposited on the preceding toner $T_1$ in an unselective manner to cause turbidity of colors.

In order to avoid this problem, there has been proposed a method (as is disclosed in Japanese Patent Application Nos. 59-181087 or 59-181550), in which the yellow and magenta toners are developed prior to the other toners by using a laser beam of near infrared rays as the image exposure means. According to this method, the yellow image underlies another color on the image retainer but overlies another color on the transfer material. Incidentally, the yellow has a higher surface reflection than those of other colors so that the multi-color image obtained by the above-specified method has its yellow color emphasized more than necessary especially in the colors having yellow in addition to green and red. This raises a problem that the colors are remarkably difficult to control. This problem leads to a serious trouble especially in case a black color is to be expressed with the yellow, magenta and cyan toners. It is, therefore, preferable to use a special toner for expressing the black color.

Incidentally, the black toner using carbon black according to the prior art has such a wide absorption wavelength range as to substantially absorb not only a visible light but also most lights to which the photoconductive layer of the image retainer is sensitive. If the development with the black toner is accomplished prior to those with the yellow, magenta and cyan toners in case a multi-color image is to be formed with the other toners, the toners of the other colors are not developed in the positions where the Black toner is applied, as has been described hereinbefore. As a result, anything but a color having low lightness and saturation can be reproduced. If, on the contrary, the development with the black toner is accomplished after those with the other toners, the contrast of the latent image potential drops to make it reluctant to deposit the black toner. This in turn drops the black density to make the letter portions obscure and make the shades reluctant to appear in intermediate color portions.

It is certified in the experiments that the transfer efficiency is increased and the transfer material can be separated more easily from the image retainer if the image retainer is subjected to a uniform exposure prior to the transfer of the toner image to the transfer material in said processes (an exposure before transfer).

The above processes are carried out in the reversal development. Direct after the development, the electric potential at the environment of the portion on the image retainer on which the toner is attached is high, but the electric potential is lowered when it is subjected to the exposure before transfer. The exposure before transfer is, however, absorbed to a large extent by the toner at the portion where the toner is attached, so that the electric potential is not lowered sufficiently. As a result, the surface potential at this environment becomes as shown in FIG. 11.

Under such circumstances, a part of the toner T forming the toner image is separated from the original position and flown in the environment or floated in the apparatus, thereby causing the inside of the apparatus being soiled.

The above phenomenon depends on the fact that the toner T receives a strong electrostatic force in a direction parallel to the surface of the image retainer as shown in FIG. 12. Arrows show lines of electrostatic force and the positively charged toner T attached on the photoconductive layer 12 receives forces in the direction of the electrostatic force.

Such a phenomenon that a part of the toner T is separated from the original position and flown in the environment causes the image to be blurred and deteriorated in quality because the end portions or thin lines of the image become vague and the noise is formed in the screen image. Further, the soil of inside of the apparatus causes a bad influence just on the operation of the apparatus and the trouble and the stain of the image.

In the multi-color image formation or the superposition of the toner images, toner is attached on the image retainer in the form of multi-layers. However, the more the distance between the position of the toner and the surface of the image retainer the more easily the separation of the toner from the surface of the image retainer will be. As stated above, the image is deteriorated, the apparatus is soiled and th recording paper is stained by moving the toner on the image retainer to the another position by a little cause, such as electrical, optical or mechanical external forces.

Further, in said process, a portion where the toner on the image retainer is attached is subjected to each step of charging→image exposing→developing→charging→ . . . , and a portion where the toner is not attached is subjected to the charging step repeatedly. Accordingly, the electric potential at the charging start time in the charging steps after the first charging step is varied due to the fact whether the toner is attached or not, or what color toner is attached. Accordingly, the surface potential of the image retainer becomes uneven, so that the toner or carrier is attached on the non-image portion or image portion on the image retainer, thereby causing the image noise or color turbidity.

Further, it is inclined that the surface potential at the previously exposed portion becomes lower than that at the portion not exposed, because of the memory effect of the photoconductive layer on the image retainer.

As stated above, the surface potential is varied according to the hysteresis of the position. Such a method of uniformly exposing before charging may be considered to avoid the variation, such exposure light is absorbed by the toner on the image retainer, so that a sufficient effect can not be expected and the image becomes vague due to the state as shown in FIG. 12.

As a method of cleaning off the toner left on the image retainer after the aforementioned image forming process, on the other hand, the method bringing a cleaning blade or a fur brush into contact with the image retainer to mechanically scrape off the toner left after the transfer is the most effective and is generally used.

Incidentally, especially in case that process is accomplished in the reversal development, the surroundings around the positions of the image retainer, to which the toners have been deposited, take higher potentials, which are highly dispersed depending upon the positions, after the transfer. As a result, an electrostatic force acts between the image retainer and the toners left after the transfer so that it restricts the toners to invite an insufficient cleaning effect. This contaminates the inside of the reproducing machine and exerts serious adverse effects upon a next image to be formed. At the charging step, more specifically, an even potential is reluctant to establish. The latent image is disturbed at the image exposure step. The toner image is blotted at the development step. The transfer is partially missing at the transfer step. Thus, the toners left uncleaned will be accumulated to cause the above-specified phenomena more.

In order to solve this problem, there is known the method of applying a uniform exposure before the cleaning step. According to this method, the charges residing on the image retainer after the transfer are eliminated to release the restrictions of the toners. If, however, the uniform exposure light is shielded by the toners, the tential difference increases between the portions where the toners are deposited and not. This shielding effect of the toners is prominent for the black toner of higher density.

Since the portions having the toners will have their potentials retained, the effect of the uniform exposure is lost to leave the insufficient cleaning unsolved. On the other hand, the portions having no toner will have their potentials drop, and the surface potential in the neighborhood is illustrated in FIG. 11.

Accordingly, it results in problems similar that in said exposure before transfer and said exposure before charging.

SUMMARY OF THE INVENTION

It is, therefore, an object of the present invention to provide an image forming method capable of clearly recording a black color at all times and expressing the colors in a balanced manner.

This object is achieved by an image forming method which is carried out by subjecting an image retainer having a photoconductive layer to an image exposure to form a latent image, by developing this latent image with a first toner having such optical transmissivities as to substantially absorb all the light in the visible range but transmit a light in a wavelength length range of 750 nm or more, by subjecting said image retainer to an image exposure with a light having such a wavelength component as to be transmitted through said toner to form a latent image, and by developing this latent image with a second toner.

Incidentally, in the multi-color image formation of the present invention, if the toners are developed in a superposed manner on the same position of the image retainer, it is unavoidable that the contrast of the latent image potentials is gradually reduced by the charges of the toner previously developed. As a result, especially if three colors are superposed, the amount of deposition of the toner of the third color will become short. According to the principle of the subtractive mixture of colors, the black color should be able to be reproduced with the yellow, magenta and cyan toners. However, this black reproduction is made remarkably difficult by the aforementioned imbalance of the latent images.

From the reason made above, it is preferable to use the black toner in addition to the yellow, magenta and cyan toners.

In the present invention, the black color is prepared not by a single coloring agent of the carbon black but by composing a plurality of coloring agents of yellow, magenta and cyan etc. These coloring agents are so selected to have transmissive components in the invisible range so that the composed color agent of the black color obtained may transmit a light of the invisible range. Moreover, the visible light is absorbed substantially completely. These coloring agents thus obtained are used to prepare the toner, i.e., the black toner. Coloring agents other than of yellow, magenta and cyan may be used.

If this toner is used in the multi-color image forming method described hereinbefore, the black toner can be developed prior to the other toners. At this time, the light source used for the image exposure has a spectral distribution in the wavelength range transmitting the black toner but not the invisible rays. As a result, a latent image can be formed on the black toner so that the toner of another color can be developed on the black toner image.

Moreover, when the toner images superposed on the image retainer are transferred to the transfer material, the black toner is formed in the upper portion on the transfer material so that the portions of the black color can be developed clearly whereas the portions of the chromatic colors can be developed in a well balanced manner.

In the prior art, the Black toner using a coloring agent other than the carbon black is disclosed in Japanese Patent Laid-Open Nos. 48-63727, 57-119363, 58-150967 and 60-239769. In these disclosures, the use of the black toner is proposed to transfer the single-color toner image, to clean the image retainer or detect the toner density. In the present invention, second and later image exposure lights have to be transmitted through the black toner previously developed. So far as this condition is satisfied, it is possible to use the black toner disclosed in the above-specified Patent Laid-Open. In case, on the other hand, a multi-color image is to be formed with toners of yellow, magenta, cyan and black, for example, the image exposure light is required for the same reason to be transmitted through not only the black toner but also the yellow, magenta and cyan toners except the last developed one. As will be described in connection with the embodiments, what has a transmissive wavelength range commonly to all the toners is in reality a near infrared light having a wavelength of 750 nm or more. In other words, the combination of the image exposure light having an infrared component and the toner transmitting the infrared component satisfies the condition of the present invention.

It is another object of the present invention to provide a multi-color image forming method which solves such problems that the image quality is reduced because the image becomes vague due to the movement of the toner on the image retainer to the another positions and that the recording paper is soiled by the toner, thereby enhancing the transfer ability of the toner image to the transfer paper and the separation ability of the transfer paper.

It is a further object of the present invention to provide a multi-color image forming method wherein the surface potential of an image retainer becomes uniform in the charging step before image exposure irrespective of the hysteresis of each position of the image retainer and which can form an image free from the noise and the color turbidity.

It is still another object of the present invention to provide a multi-color image forming method wherein a residual toner on an image retainer is cleaned sufficiently, so that such problems that toner is scattered and the inside of an apparatus or a transfer paper is stained can be solved.

The above objects can be attained by an image forming method comprising the steps of:

forming a latent image by subjecting an image retainer having a photoconductive layer to an image exposure; forming a toner image by developing said latent image with a toner; repeating at least one time each the step of forming said latent image and the step of forming said toner image; transferring a plurality of toner images formed on said image retainer to a transfer material; and uniformly exposing said image retainer on which toner exists with a light containing a wavelength component of 750 nm or more, wherein at least one of said toner images is formed with a toner which has such a spectral transmissivity as to substantially absorb a visible light but substantially transmit a light having a wavelength of 750 nm or more. Here, the uniformly exposing step means an exposure before transfer, an exposure before charging or an exposure before cleaning.

The problems of the exposure under the existence of the toner according to the prior art are caused by the difference in the spectral transmissivities of the individual toners. When the exposures are performed from above the toners, more specifically, their effective amount reaching the image retainer depends upon the value which is obtained by integrating the product of the intensity of the light irradiated by exposure means, the transmissivities of the toners and the optical sensitivity of the image retainer with respect to the wavelength. This integrated value is small for a specific uniform exposure to raise the aforementioned problems. FIG. 8 illustrates the spectral transmissivities of the yellow, magenta and cyan toners. The spectral characteristics of this toner are measured by applying an excellently transmissive both-side tape to one side of an OHP sheet to prepare an adhesive face. The toner is uniformly applied to this adhesive face to form a substantially single toner layer, which is melted by the solvent, smoothed in the thickness of 5–10 μm, and dried to measure the spectral transmissivity. This is corrected with the spectral transmissivity of the OHP only into the spectral transmissivity of the toner. For this measurement, the spectrophotometer (HITACHI 330 type) of Hitachi, Ltd., and the wavelength is within a range of 360 to 850 nm.

If a white light, for example, is used as an exposure light before cleaning, the effective exposure amount is dependent upon the toner existing on the image retainer, as will be found in view of FIG. 8. We have conceived the present invention, noting that, if a common wavelength not to be absorbed by the individual toners is found out to effect the exposure with the light having most of its spectral distribution in that wavelength range, it is transmitted through the individual toners on the image retainer so that the photoconductive layer on the image retainer acquire a substantially equal exposure.

The prior art toner using the carbon black as its coloring agent has such a wide absorption wavelength range as to substantially absorb not only the visible light but also the light of the wavelength range to which the photoconductive layer of the image retainer is sensitive. The spectral transmissivity of this black toner is plotted by a broken curve in FIG. 8. In case a uniform exposure is accomplished after a toner image has been formed with the black toners, its light is absorbed by the black toner to raise the aforementioned problems. Therefore, the uniform exposure light is not sufficient, if it is transmitted through the yellow, magenta and cyan toners, but has to be transmitted through the black toner, too. For these transmissions, the spectral transmissivity of the black toner has to be identical to those of the other toners.

In the prior art, the black toner using coloring agents other than the carbon black is disclosed in Japanese Patent Laid-Open Nos. 48-63727, 57-119363, 58-150967 and 60-239769. In these disclosures, it has been proposed to use the aforementioned black toner so as to transfer a single-color toner image, to clean the image retainer or detect the toner density. If, in the present invention, the toner existing on the image retainer contains the black toner, this black toner naturally has to transmit the exposure light as well as the other color toners. Therefore, the black toners disclosed in the above-specified Pat. Laid-Open can be used so long as it satisfies the conditions that the transmissive wavelength range of the black toner is shared with those of the other color toners and that the exposure light has that wavelength component.

DESCRIPTION OF THE PREFERRED EMBODIMENTS

Figure 1:
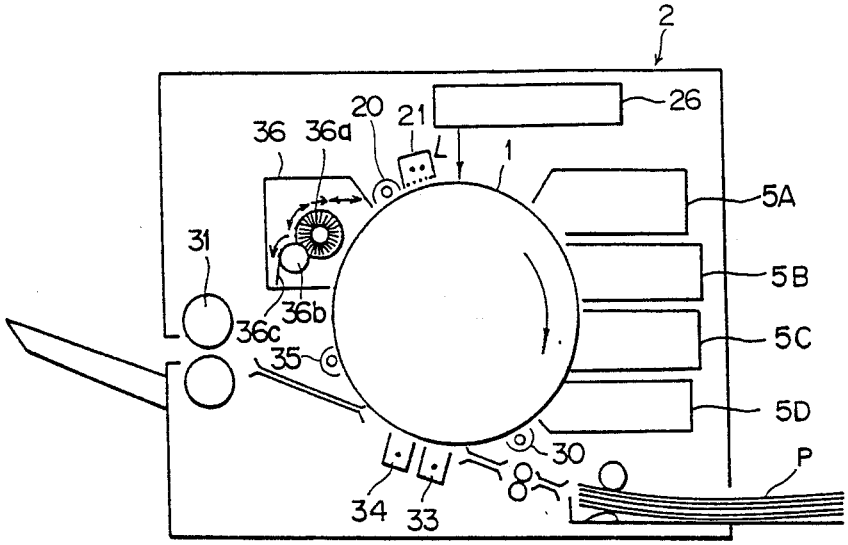
FIG. 1 is a schematic diagram showing a multi-color image forming apparatus using the image forming method of the present invention.

FIG. 1 shows a multi-color image forming apparatus constructed according to one embodiment of the present invention. In FIG. 1: reference numeral 1 denotes an image retainer rotating in the direction of arrow; numeral 21 a corona charging device; letter L an image exposure light emitted from a laser optical system 26; numerals 5A, 5B, 5C and 5D developing devices having the yellow, magenta, cyan and black toners; numeral 33 a transfer electrode; numeral 34 a separation electrode; letter P sheets of recording paper; and numeral 36 a cleaning device having a fur brush 36a, a toner recovery roller 36b and a scraper 36c. The multi-color image forming apparatus thus constructed forms a multi-color image in the following manner.

The image retainer 1 is uniformly irradiated, if necessary, by an exposure lamp 20 and is then uniformly charged by the corona charging device 21 consisting of a scorotron charging electrode. Subsequently, the image retainer 1 is irradiated with the image exposure light L emitted from the laser optical system 26 in accordance with recording data. Thus, an electrostatic latent image is formed. This latent image is developed by the developing device 5D containing a first toner $T_1$ (i.e., the black toner).

The image retainer provided with the toner image is uniformly charged again by the corona charging device 21 and is exposed to an image exposure light L according to the recording data of another color component. The electrostatic latent image thus formed is developed by the developing device 5C containing a second toner $T_2$ (i.e., the cyan toner). As a result, the image retainer 1 is provided thereon with a two-color toner image with the first toner $T_1$ and the second toner $T_2$. Subsequently, a toner $T_3$ (i.e., the magenta toner) and a toner $T_4$ (i.e., the yellow toner) are likewise developed in a superposed manner by the developing devices 5B and 5A, respectively, to form a four-color toner image on the image retainer 1.

This multi-color toner image thus obtained on the image retainer 1 is uniformly irradiated, if necessary, by an exposure lamp 30 before transfer and is then transferred to the recording paper P by the transfer electrode 33. Then, this recording paper P is separated from the image retainer 1 by the separation electrode 34 and is fixed by a fixing device 31. In this meanwhile, the image retainer 1 is uniformly exposed by an exposure lamp 35 before cleaning and is then cleaned by the cleaning device 36. The fur brush 36a of the cleaning device 36 is held out of contact with the image retainer 1 during the image formation. If the multi-color image is formed on the image retainer 1, the fur brush 36a is brought into contact with the image retainer, after the multi-color image has been transferred, so that it scrapes off the toners left after the transfer while rotating in the direction of arrow.

After the cleaning step, the fur brush 36a leaves again the image retainer 1. The toner recovery roller 36b is suitably biased, while rotating in the direction of arrow, to recover the toner T or the like from the fur brush 36a. The toner T thus recovered is further scraped off by the scraper 36c.

Figure 2:
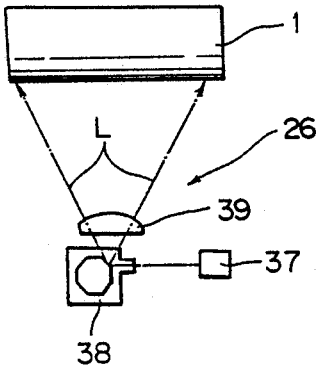
FIG. 2 is a diagram showing a laser optical system.

The laser optical system 26 of the embodiment is shown in FIG. 2. In FIG. 2: reference numeral 37 denotes a semiconductor laser diode; numeral 38 a polygon mirror; and numeral 39 an f$\theta$ lens.

Figure 3:
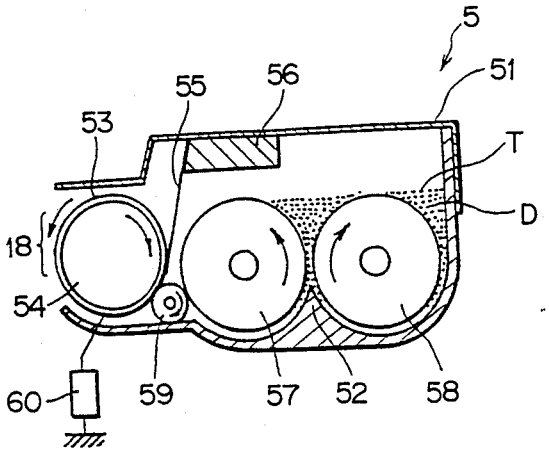
FIG. 3 is a section showing a developing device.
Figure 4:
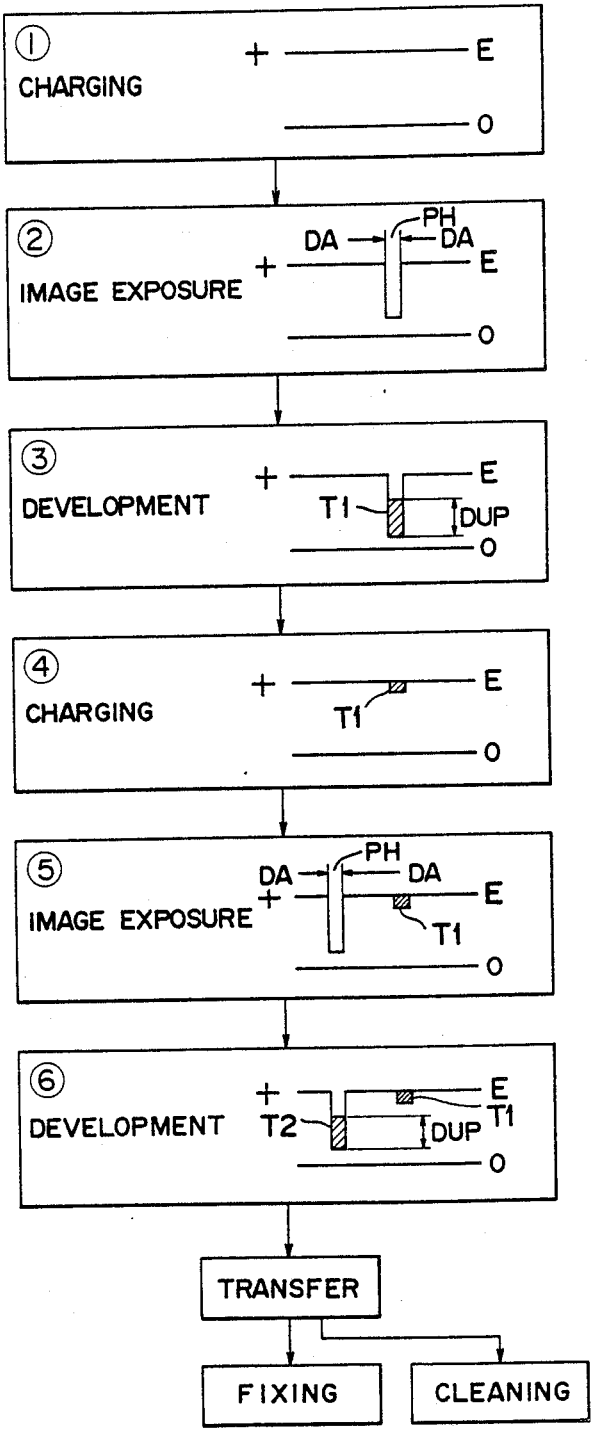
FIG. 4 presents diagrams showing the change of the surface potential on an image retainer.

FIG. 3 is a section showing the developing device 5A. In FIG. 3: reference numeral 51 denotes a housing; numeral 53 a sleeve; numeral 54 magnetic field generation means or a magnetic roll disposed in a developer carrying member, i.e., sleeve and having N and S poles; numeral 55 a layering member; numeral 56 a fixing member for fixing the layering member 55; numeral 57 a first agitation member; and numeral 58 a second agitation member. Numeral 59 denotes a sleeve cleaning member; numeral 60 a developing bias power source; numeral 18 a development region, i.e., the region in which the toner carried by the sleeve 53 is moved upon receiving the electrostatic force from the image retainer; letter T the toner; and letter D a developer. In the developing device thus constructed, the two agitation members 57 and 58 are in the form of a screw which is rotated in the directions of arrows to agitate and carry the developer. The agitation member 57 is shaped to carry the developer toward the reader with respect to the drawing sheet whereas the agitation member 58 is shaped to carry the developer apart from the reader. In order to prevent the developer from residing in the intermediate region between the two agitation members 57 and 58, there is disposed a wall 52 by which the developers at the right and left sides of the drawing sheet are exchanged at that region.

The toner supply to this developing device 5 is accomplished from this side of FIG. 3 so that the toner supplied is generally circulated into the paper surface by the agitation member 58 and out of the paper surface by the agitation member 57 until it is uniformly mixed with the carrier. However, the position of the toner supply should not be limited to the above arrangement but may be modified such that the toner is uniformly supplied to the sleeve shaft from the righthand side of FIG. 3, for example.

Thus, the developer D is sufficiently agitated and mixed and is carried in the same direction as the rotating direction of the sleeve 53 by the carrying force of the sleeve 53 and the magnetic roll 54 rotating in the directions of the arrows. The layering member 55 held by the fixing member 56 extending from the housing 52 is forced into contact with the surface of the aforementioned sleeve 53 so that it regulates the amount of the developer D carried to form a developer layer.

Incidentally, as another means for forming the developer layer when the development of the present embodiment is to be accomplished, there can be used either of the known means such as a magnetic or nonmagnetic regulating plate, which is arranged at a constant spacing from the sleeve, or a magnetic roll which is arranged in the vicinity of the sleeve.

The smaller diameter of the carrier and toner composing the developer is the more advantageous for the resolution of the image quality and the reproductivity of gradation. For example, even if the carrier of the developer layer has a small diameter of 40 microns less the impurity or granule in the developer can be eliminated automatically to form a magnetic brush having a uniform length by means of the aforementioned layering member 55 or the like. Even if, moreover, the aforementioned carrier is made to have a diameter as small as that of the toner, too, the impurity can be prevented from any inclusion to form a magnetic brush having a uniform length.

The sleeve cleaning roller 59 rotates in the direction of the arrow (as shown in FIG. 3) to scrape off the developer, which has passed through a developing region 18 and consumed the toner T, from the sleeve 53. This makes it possible to maintain the amount of the toner T to be carried to the developing region so that the developing condition is stabilized.

Next, the composition of the developer to be used in the developing method of the present embodiment will be described in the following.

Recipe of Developer

| Toner composition | |
|---|---|
| polystyrene | 45 wt. parts |

-continued

| Toner composition | |
|---|---|
| polymethyl methacrylate | 44 wt. parts |
| burrfast (charge controller) | 0.2 wt. parts |
| coloring agent | 10.5 wt. parts |

This composition is mixed, blended and classified to prepare a desired toner.

(Resin-Coated) Carrier Composition:

| | |
|---|---|
| Core | ferrite |
| Coating Resin | styrene acryl (4:6) |
| Magnetization | 27 emu/g |
| Particle Diameter | 30 microns |
| Specific Gravity | 5.2 g/cm$^3$ |
| Specific Resistance | $10^{13}$ ohms cm or more |

This composition is mixed, blended and classified until it is treated with hot air into a spheric carrier.

For the toner coloring agent: Auramine is used.

The known one is used as the coloring agent of the chromatic toners (e.g., yellow, magenta and cyan), as will be exemplified in the following: Benzidine Yellow G (C.I. 21090); Benzidine Yellow GR (C.I. 21100); Permanent Yellow DHG (produced by Hoechst); Brilliant Carmine 6B (C.I. 15850); Rhodamine 6G Lake (C.I. 45160); Rhodamine B Lake (C.I. 45170); Rhthalocyanine Blue non Crystal (C.I. 74160); Phthalocyanine Green (C.I. 74260); Carbon Black; Fat (Fa.) Yellow 5G; Fat Yellow 3G; Fat Red G; Fat Red HRR; Fat Red 5B; Fat Black HB; Zapon Fast; Black RE; Zapon Fast Black B; Zapon Fast Black B; Zapon Fast Blue HFL; Zapon Fast Red BB; Zapon Fast Red GE; Zapon Fast Yellow G; and Quinacrydone Red (C.I. 465000). As the coloring agent of the black toner used is prepared by mixing a plurality of kinds of coloring agents. The conditions for these coloring agents to be mixed are as follows:

(1) The absorption ranges should be compensated mutually in the visible range (360 to 700 nm); and (2) There should be a common wavelength range in which a wavelength range of 750 nm or more can be transmitted.

Under the condition (1), the black color can be expressed. Under the condition (2), on the other hand, the light in the common wavelength range can be transmitted through the black toner. Therefore, if this light is used for the image exposure, as has been described hereinbefore, an excellent latent image can be formed.

We mixed the following pigments to measure the light absorption rate:

| | |
|---|---|
| (1) Pigment Yellow 97: | 3.5 parts |
| (2) Pigment Red 146: | 4 parts |
| (3) Pigment Blue 15:3 | 3 parts |

These pigments were mixed, melted and blended, and pulverized and classified at the following mixing ratio:

| | |
|---|---|
| Main resin (e.g., polyester) | 100 parts |
| Parting agent (e.g., wax) | 6 parts |
| Pigments | 5 to 10 parts |

The measuring method of the light absorption rate is as follows:

(1) A solvent (for melting a resin, such as acetone) was added at a weight ratio of 5 times to the resin to melt the toner and the molten toner is dispersed with a stirring blade and glass beads;

(2) This molten toner was applied to have a thickness of 5 to 10 microns on the OHP sheet by a wire bar etc.; and (3) This molten toner on the OHP sheet was dried to measure the light absorption rate by the spectrophotometer (HITACHI 330 Type) manufactured by Hitachi Ltd.

The wavelength measured was within a range of 360 to 850 nm.

Incidentally, the light absorption rate is defined by the following formula:

| | |
|---|---|
| log(1/T) | (T: reflexibility (= amount of reflected light/amount of incident light). |

Figure 6:
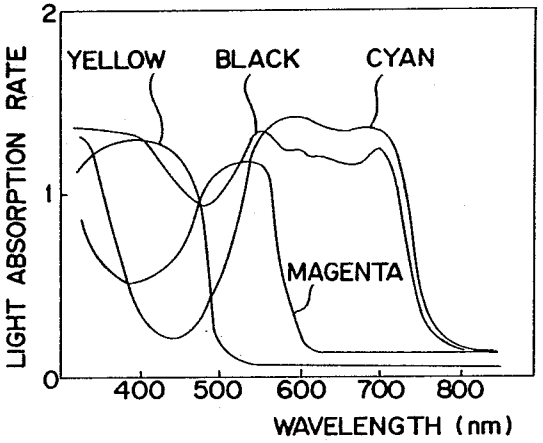
FIGS. 6 and 7 are graphs illustrating, the light absorption rate of the toners according to the embodiment of the present invention.

The results are plotted in FIG. 6. From this graph, it is apparent that the visible range has a substantially uniform absorption whereas the infrared range has a high transmissivity.

Figure 7:
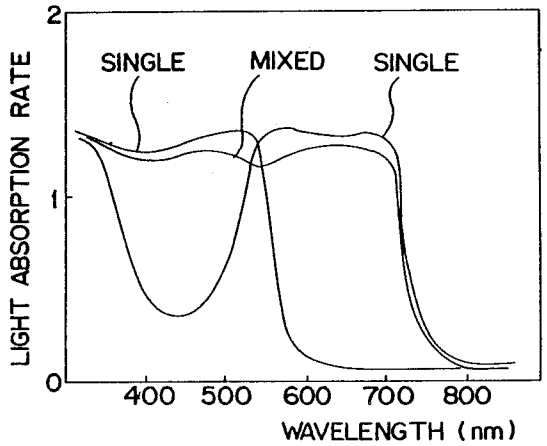
Figure 5A:
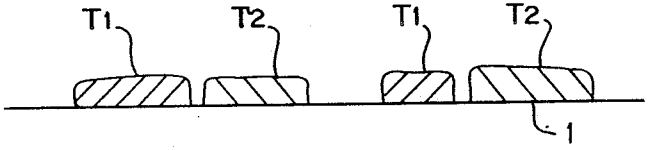
FIGS. 5 A to 5 D are schematic diagrams showing the deposited states of toners on the image retainer.
Figure 5B:
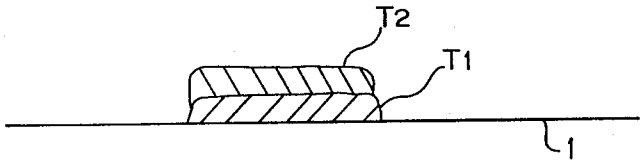
Figure 5C:
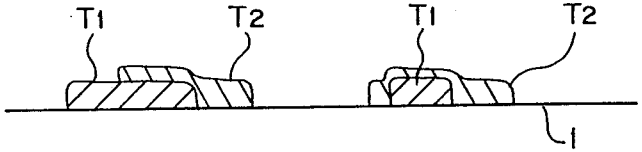
Figure 5D:
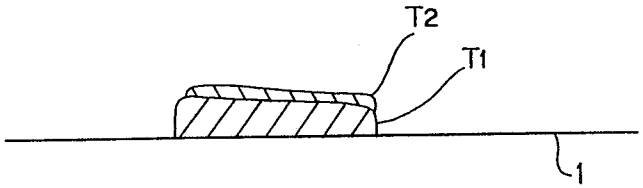
Figure 8:
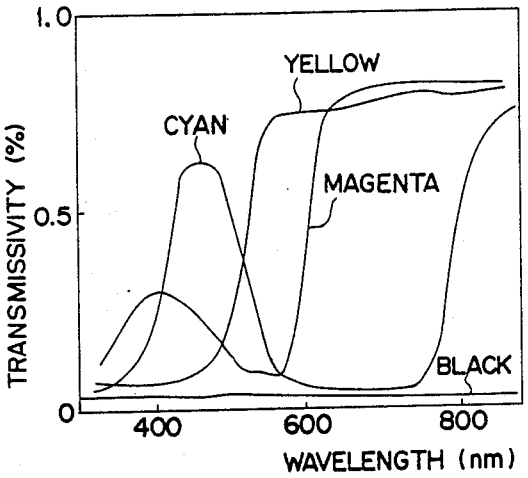
FIG. 8 is a graph illustrating the spectral transmissivities of the toners.

Next, the following pigments were likewise used to prepare a toner, whose light absorption rate was measured, as plotted in FIG. 7:

| | |
|---|---|
| (1) Pigment Red 57:1 | 6 parts |
| (2) Pigment Blue 15:3 | 6 parts. |

We prepared the toners on trial with other various coloring agents and have found the fact that satisfactory results were obtained for a light absorption rate of 0.7 or preferably 0.4 or less within the main wavelength of uniform exposure For the black toner:

(1) An excellent black color is obtained for an light absorption rate of 0.8 or more over all the visible range; and (2) The item (1) is achieved when the light absorption rate of each coloring agent has the maximum of 0.9 or more within each visible wavelength range.

If, moreover, this toner is used in the apparatus of FIG. 1 under the condition as tabulated in Table 1, a latent image of high contrast is obtained no matter what order the color is, in case the light absorption rate is 0.4 or preferably 0.2 less in the main wavelength of the image exposure. As a result, if this black toner is previously developed, a toner of another color can be superposed thereon in the case of the reversal development so that a multi-color image in excellent color balance can be attained with the black color being suitably stressed on the transfer material.

Incidentally, in the present embodiment, the semiconductor laser used for the image exposure is well known in the prior art and has a main wavelength of 780 nm. The light having this wavelength will be transmitted through not only the above-specified black toner but also the individual yellow, magenta and cyan toners.

TABLE 1

| | |
|---|---|
| Main Scanning Rate of Laser Beam | 800 m/s |
| Aux. Scanning Rate of Laser Beam | 150 mm/s |
| Time of Scanning One Image | 78 ns |
| Image Retainer | Organic Photosensitive Member (Drum of 180 ϕ mm) |
| Linear Velocity | 150 mm/s (c.w.) |

TABLE 1-continued

| | |
|---|---|
| Surface Potential | |
| Unexposed | −700 V |
| Exposed | −50 V |
| Sleeve (Common) | |
| Diameter | 20 mm |
| Material | Non-magnetic Stainless Steel (having blasted surface of 3 microns) |
| Linear Velocity | 500 mm/s (c.c.w.) |
| Magnetic Roll (Common) | |
| Number of Poles | 12 |
| Rotating Speed | 1,500 r.p.m. (c.w.) |
| Density of Magnetic Flux of Sleeve Surface (Common) | 600 G (Max) |
| Developing Gap (Common) | 500 microns |
| Bias DC | |
| Yellow | −600 V |
| Magenta | −600 V |
| Cyan | −600 V |
| Black | −650 V |
| AC (Common) | 3 $KV_{p-p}$, 5 KHz |
| Amount of Toner Deposited on Sleeve (Common) | 0.6 $mg/cm^2$ |

Writing Resolution: 16 dots/mm. Writing Level: Binary

The exposure lamp 20,30, 35 may be exemplified by a variety of light source for emitting infrared rays or a white light source covered with an infrared transmissive filter.

In the present embodiment:

(1) Infrared Light Emitting Diode (product LN 172 of Matsushita Electric Co., Ltd.)

Figure 9:
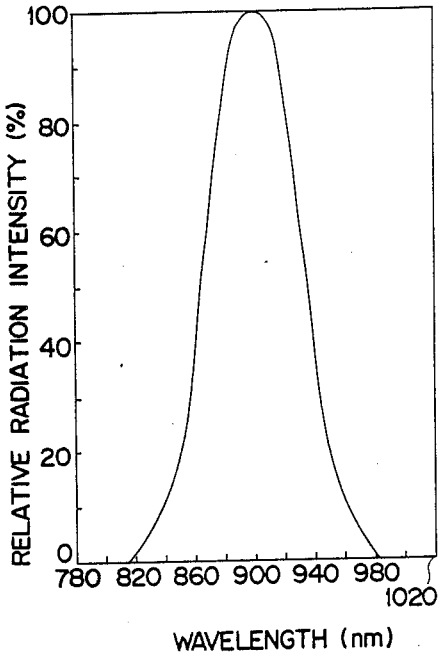
FIG. 9 is a graph illustrating the radiation spectral characteristics of an infrared light emitting diode of GaAlAs.

This light emitting spectrum is plotted in the spectral distribution of FIG. 9; and (2) Combination of Halogen Lamp and Infrared Transmissive Filter (product IR-D70 of Toshiba Glass Co., Ltd.)

Figure 10:
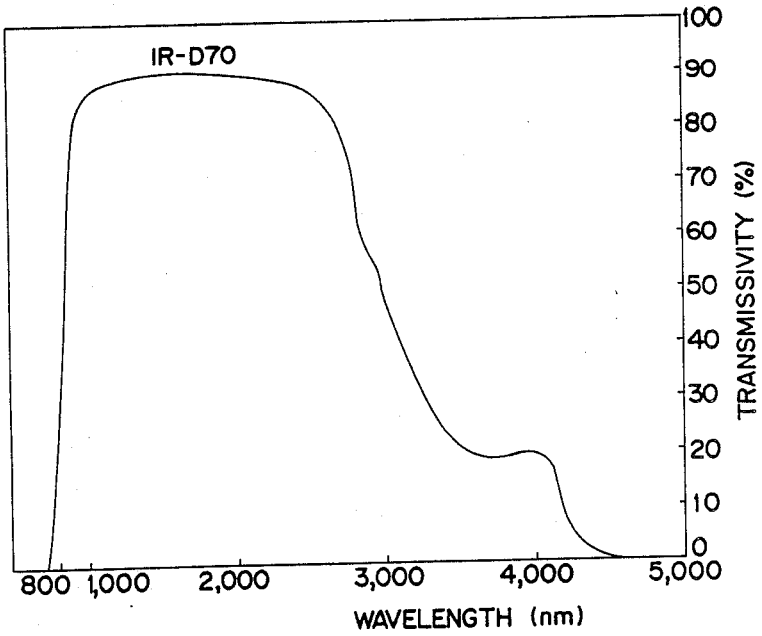
FIG. 10 is a graph illustrating the spectral transmissivity of the combination of a halogen lamp and an infrared transmissive filter.

The spectral transmissivity of this combination is plotted in FIG. 10. The exposure lamp 20,30,35 used belongs to the above item (1) or (2).

Figure 13:
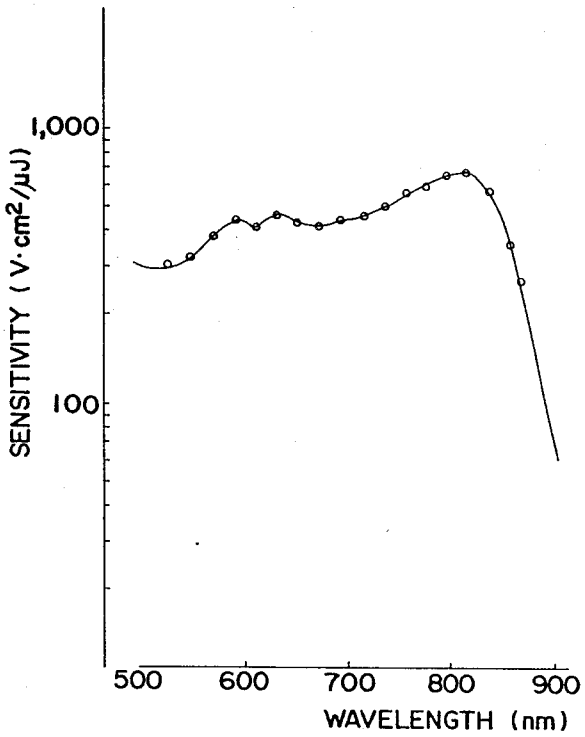
FIG. 13 illustrates the spectral sensitivities of the image retainer.
Figure 11:
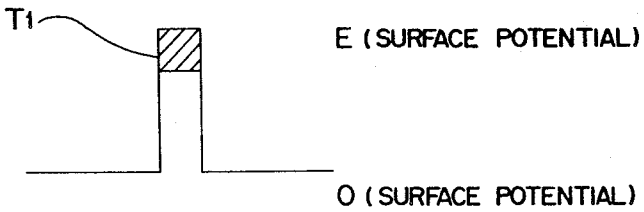
FIG. 11 illustrates the potential of the portion of the image retainer, on which the toner is deposited.
Figure 12:
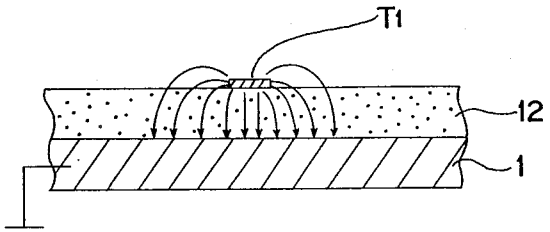
FIG. 12 illustrates the electrostatic force of the portion of the image retainer, on which the toner is deposited.

FIG. 13 is a graph plotting the spectral sensitivity of the image retainer.

According to the present invention, there is provided a toner and an image forming method, which can clearly record a black color at all times and express colors in a well-balanced fashion.

According to the present invention, moreover, there is provided a multi-color image forming method which can sufficiently clean the residual toner from the image retainer by the cleaning device while preventing the toner dispersion and solving the problem of blotting the inside of the apparatus and the recording paper.

According to the present invention, still moreover, the surface potential of the image retainer can be made constant irrespective of the hysteresis of each position to stably form a multi-color image having neither noise nor color turbidity.

According to the present invention, furthermore, there is provided a multi-color image forming method which can effect an excellent transfer to a sheet recording paper while solving the problem that the toner on the image retainer will shift to another position to deteriorate the image quality and blot the recording paper.

What is claimed is:

1. An image forming method comprising:

uniformly exposing an image retainer having a photoconductive layer, with a light containing a wavelength component of 750 nm or more;

forming a latent image by subjecting the image retainer to charging and image exposure;

forming a toner image by developing said latent image with a toner;

repeating at least once each of the steps of forming said latent image and forming said toner image; and transferring a plurality of toner images formed on said image retainer to a transfer material;

wherein at least one of said toner images is formed with a toner having a spectral transmissivity such as to substantially absorb a visible light but substantially transmit a light having a wavelength of 750 nm or more.

2. An image forming method comprising:

forming a latent image by subjecting an image retainer having a photoconductive layer to charging and image exposure;

forming a toner image by developing said latent image with a toner;

repeating at least once each of the steps of forming said latent image and forming said toner image;

uniformly exposing said image retainer on which toner exists, through said toner with a light containing a wavelength component of 750 nm or more; and transferring a plurality of toner images formed on said image retainer to a transfer material;

wherein at least one of said toner images is formed with a toner having a spectral transmissivity such as to substantially absorb a visible light but substantially transmit a light having a wavelength of 750 nm or more.

3. An image forming method according to claim 1, wherein the light for the image exposure contains a wavelength component of 750 nm or more.

4. An image forming method according to claim 1, wherein the developments at the step of forming said toner image and said repeating step are of the reversal type.

5. An image forming method according to claim 2, wherein the developments at the step of forming said toner image and said repeating step are of the reversal type.

6. An image forming method according to claim 1, wherein said toner having such a spectral transmissivity as to substantially absorb a visible light but substantially transmit a light having a wavelength of 750 nm or more is the black toner.

7. An image forming method according to claim 1, wherein the plurality of toner images are formed with such a toner as to substantially transmit a light having a wavelength of 750 nm or more.

8. The method of claim 2 wherein said image retainer is uniformly exposed to said light containing wavelength component prior to the formation of said first latent image.

9. The method of claim 2 wherein said toner having a spectral transmissivity as to substantially absorb a visible light but substantially transmit a light having a wavelength of 750 nm or more is a black toner.

10. The method of claim 2 wherein said plurality of toner images are formed with toner through which a light having a wavelength of 750 nm or more can be substantially transmitted.

11. The method of claim 2 wherein light for image exposure contains a wavelength component of 750 nm or more.

* * * * *